US005524882A

United States Patent [19]

Wagner

[11] Patent Number: 5,524,882

[45] Date of Patent: Jun. 11, 1996

[54] GOAL POST PAD

[76] Inventor: Charles K. Wagner, #2 Timber La. E., Palermo, N.J. 08223

[21] Appl. No.: 125,183

[22] Filed: Sep. 23, 1993

[51] Int. Cl.[6] ..... A63B 71/00

[52] U.S. Cl. ..... 273/1.5 R; 70/68; 267/140

[58] Field of Search ..... 273/1.5 R, 1.5 A, 273/55 D; 267/140; 70/68

[56] References Cited

U.S. PATENT DOCUMENTS

| | | | |
|---|---|---|---|
| D. 250,283 | 11/1978 | Norton | D34/5 VV |
| 1,557,433 | 10/1925 | Delamater et al. | 70/68 X |
| 3,179,397 | 4/1965 | Cleereman et al. | 267/140 |
| 3,516,666 | 6/1970 | Trimble et al. | 273/55 |
| 3,546,058 | 12/1970 | Loew | 161/59 |
| 3,782,724 | 1/1974 | Rottman et al. | 273/55 R |
| 3,831,941 | 8/1974 | Pease | 273/55 D |
| 3,908,992 | 9/1975 | Cunningham et al. | 273/55 R |
| 4,514,915 | 5/1985 | Galetta | 70/68 X |
| 4,538,808 | 9/1985 | Holland | 273/1.5 A |
| 4,867,135 | 9/1989 | Stecker | 126/500 |
| 4,881,734 | 11/1989 | Nye | 273/1.5 R |
| 4,973,054 | 11/1990 | Metrosky | 273/1.5 R |
| 5,022,649 | 6/1991 | Traub et al. | 273/1.5 R |
| 5,050,925 | 9/1991 | Brown | 296/136 |
| 5,058,566 | 10/1991 | Dabbs et al. | 126/500 |
| 5,112,023 | 5/1992 | Sowers | 248/519 |

FOREIGN PATENT DOCUMENTS

| | | | |
|---|---|---|---|
| 252831 | 12/1985 | Japan | 267/140 |

OTHER PUBLICATIONS

Korney Board Aids, Basketball Coaching and Training Aids 1989 School Mail Order Catalog, Dec. 1988, p. 33, Standard Safety Pad.

*Primary Examiner*—Paul E. Shapiro
*Attorney, Agent, or Firm*—H. Dennis Kelly; Timmons & Kelly

[57] ABSTRACT

A goal post for football or basketball has a vertical post, surrounded by a foam pad. The foam pad is surrounded by an outer layer of a solid or mesh vinyl fabric material, wrapped around and bonded to the foam pad. A zipper is attached to the outer layer of fabric for securing the pad to the post. A cable having a ring on each end is attached to the lower edge of the outer layer of material. The rings can be locked to a ring on the slide fastener to secure the zipper.

6 Claims, 2 Drawing Sheets

GOAL POST PAD

BACKGROUND OF THE INVENTION

1. Field of the Invention

This invention relates in general to goal post structures of the type used in football or basketball. In particular, the invention relates to pads for goal posts to be used in games where the goal post is in or near the field of play, such as football and basketball.

2. Description of Related Art

In some sports, notably football and basketball, there are goal posts in or near the field of play. Since these posts are usually made of steel or wood, it is dangerous for players to run into the goal posts.

At first, goal posts were padded by wrapping a mattress-like pad around the post, and tying the pad to the post with rope or wire. These pads were not particularly resilient, and were difficult to install and to remove.

Then, specially designed pads were manufactured with grommets along the edges. A rope was intertwined through the grommets to tie the pad to the goal post.

A further improvement was the introduction of cylindrical pads made of resilient foamed synthetic plastic resin, covered by an unfoamed outer skin. U.S. Pat. No. 3,782,724, issued Jan. 1, 1974, to Rottman et al., discloses such a padded goal post. The pads shown in the Rottman et al. patent are secured around the pole, and to one another, by several hook and loop fasteners.

Goal post pads still had several deficiencies. The padding was either permanently attached or was easily removed. If the padding was permanently attached, it was subject to the adverse effects of the weather. If the padding was too easily removed, it had to be removed and stored to prevent theft or vandalism.

SUMMARY OF THE INVENTION

The goal post pad of the invention has several objects. One object of the invention is to securely fasten a pad to a goal post, in order to prevent theft and vandalism, while allowing easy removal for storage when desired. Another object of the invention is to secure a foam pad to a goal post, while allowing the foam pad to dry easily if the pad gets wet.

These objects are accomplished by a goal post pad having a foam pad to be wrapped around a vertical goal post. An outer layer of fabric is wrapped around and bonded to the foam pad. A lockable slide fastener is attached to the outer layer of fabric and secures the fabric and the foam pad to the goal post.

The outer layer of fabric may be either a solid non-porous vinyl material, or a porous vinyl mesh. The solid material will help keep the pad dry. If the pad gets wet, a porous vinyl mesh outer fabric will allow the pad to dry faster.

The above, as well as additional objects, features, and advantages of the invention will become apparent in the following detailed description.

DESCRIPTION OF THE PREFERRED EMBODIMENT

Figure 1:
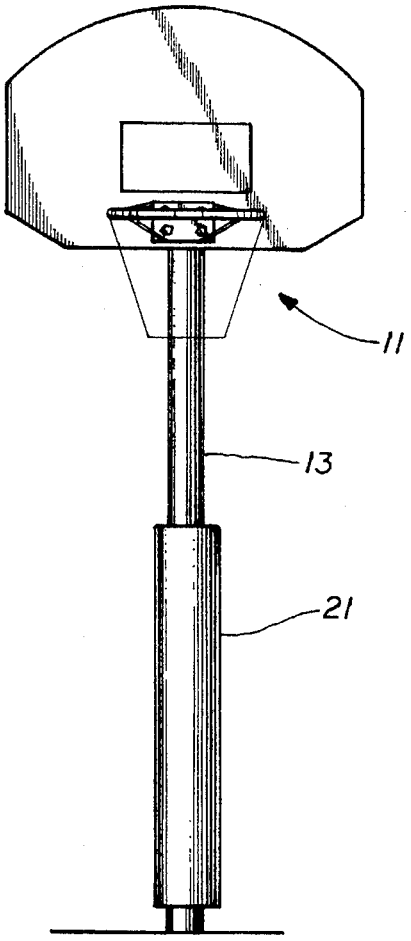
FIG. 1 is a front elevation of a basketball goal according to the preferred embodiment of the invention.
Figure 2:
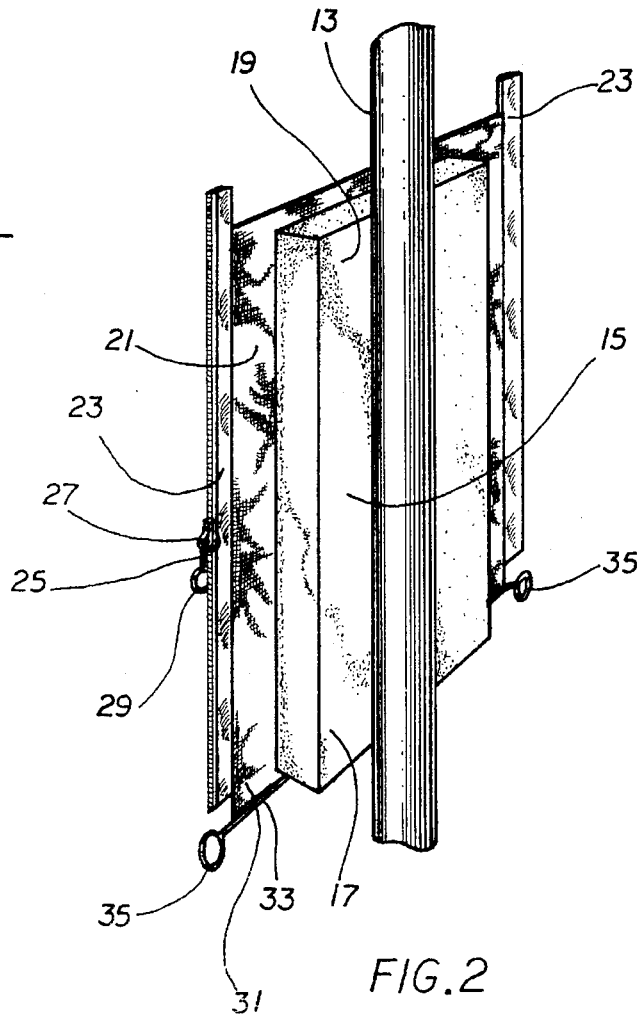
FIG. 2 is a close-up perspective view of the basketball goal shown in FIG. 1, with the pad ready to be installed on the post.

The preferred embodiment of the invention is described and shown in the drawings as being used on a basketball goal post 11. The invention would be equally effective in several other sports, such as on football goal posts.

The typical goal post 11 has a vertical post 13, usually made of steel, wood, or other suitable material. A standard post 13 is about ten inches (about 25 centimeters) in circumference. The post 13 may be permanently embedded in the ground, or may be mounted on a portable stand.

Figure 3:
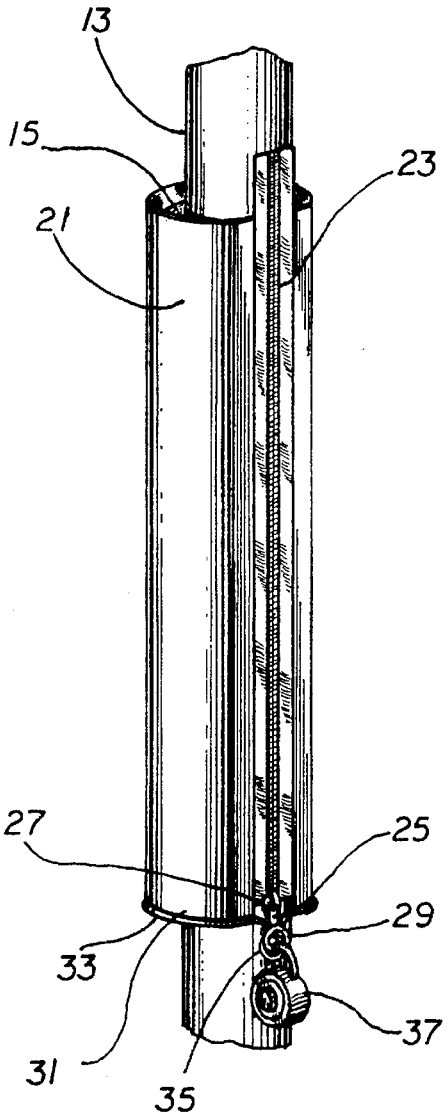
FIG. 3 is a close-up perspective view of the basketball goal shown in FIG. 1, with the pad installed.

A resilient foam pad 15 is wrapped around the post 13 to absorb the energy of any player who runs or jumps into the post 13. The pad 15 is made of a foamed plastic material of a type well known in the art. The pad 15 is about two inches (about 11 centimeters) thick, and is about sixteen inches (about 84 centimeters) wide. When the pad 15 is installed on the post 13, the pad 15 reaches most of the way around the post 13, as shown in FIG. 3.

The pad 15 is installed on the post 13, with the lower end 17 of the foam pad 15 about one foot (30 centimeters) above ground level. The pad 15 is about six feet (1.83 meters) long, so the upper end 19 of the pad 15 is located about seven feet (2.13 meters) above ground level. This length will be sufficient to cover almost any contact between a player and the goal post 11.

An outer layer of fabric 21 is wrapped around the outer surface of the foam pad 15, and bonded with glue or some other adhesive. This outer layer 21 may be either a solid non-porous vinyl material, or a porous vinyl mesh. A solid material is preferable if the desire is to keep moisture away from the foam pad 15. On the other hand, a porous mesh material will allow the foam pad 15 to dry more quickly if it becomes wet.

The outer layer of fabric 21 is about 21 inches (53 centimeters) wide and about 74 inches (188 centimeters) long. The outer layer 21 is attached to the foam pad 15 with about one inch (3 centimeters) of the fabric 21 extending above and below the pad 15.

A fastener 23 is attached to the outer layer of fabric 21 for securing the fabric 21 and the foam pad 15 to the post 13. The two halves of the fastener 23 are attached to the edges of the outer fabric 21. The preferred fastener 23 is a heavy duty slide fastener, having a pull tab 25 attached to the slide 27 of the slide fastener 23 for opening and closing the fastener 23.

The slide fastener 23 is about six feet (1.83 meters) long, and the upper end of the fastener 23 is several centimeters above the upper edge of the outer fabric 21. The extra portion of the fastener 23 extending above the outer fabric 21 facilitates the closing of the fastener 23. When the fastener 23 is closed, the upper portion of the fastener 23 can be tucked between the outer fabric 21 and the post 13.

Figure 4:
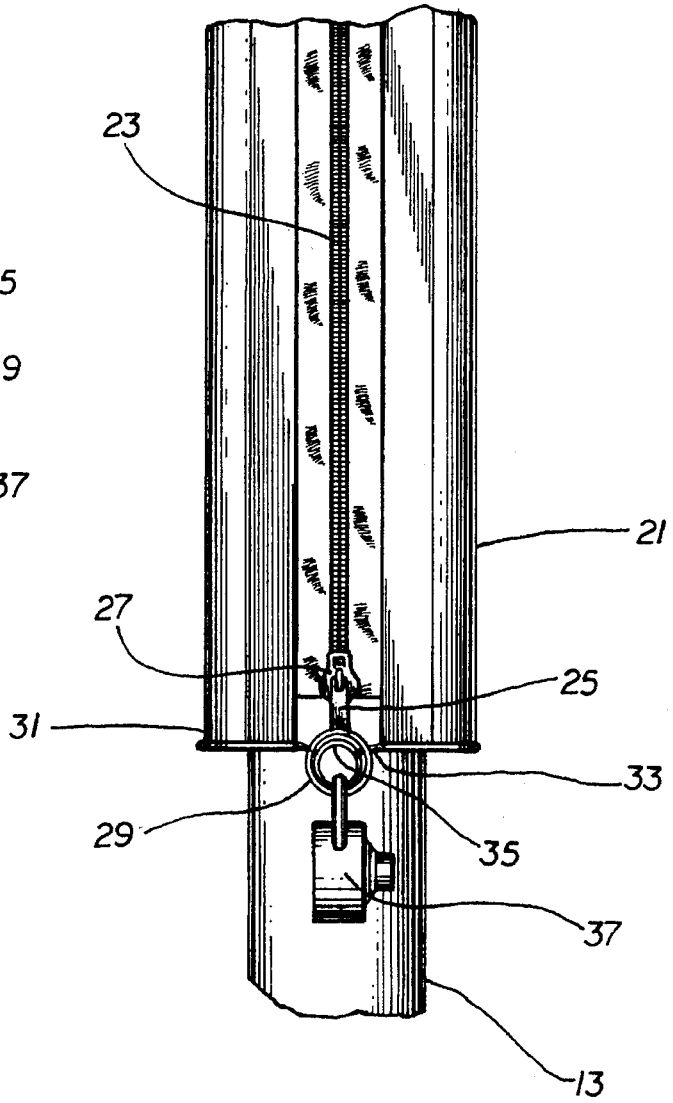
FIG. 4 is a close-up rear elevation of the basketball goal, with the pad installed.

A ring 29 is attached to the outer end of the pull tab 25, so that the ring 29 hangs down below the slide fastener 23. When the slide fastener 23 is completely closed, as shown in FIGS. 3 and 4, the ring 29 is even with the lower edge 31 of the outer fabric 21.

A cable 33 is attached to the lower edge 31 of the outer fabric 21. The cable 33 may run through a loop on the lower edge 31 of the fabric 21, or the cable 33 may be glued or otherwise secured to the fabric 21. If the outer layer of fabric 21 is not bonded to the foam pad 15, a second cable may be similarly attached to the upper end of the outer fabric 21.

The cable 33 has a ring 35 on each end. These rings 35 are the same diameter as the ring 29 on the pull tab 25. When the fastener 23 is closed, the rings 35 on the outer fabric 21 can be aligned with the ring 29 on the pull tab 25, as shown in FIGS. 3 and 4.

A padlock 37, such as a combination lock or a key lock, can be inserted through the rings 29 and 35 to lock the slide fastener 23 in the closed position.

A person having the key or the combination to the padlock 37 can easily remove the lock 37 from the rings 29 and 35. The fastener 23 can then be opened, and the pad 15 can be easily removed from the post 13.

The goal post pad of the invention has several advantages over the prior art. The slide fastener 23 gives the pad 15 a neat, tailored appearance, and keeps the pad 15 from twisting down the post 13. The pad 15 is secured to the post 13, and yet the pad 15 can be easily installed and removed by an authorized person having the key or the combination to the lock 37. Additionally, a mesh outer fabric allows a wet foam pad 15 to dry more quickly.

The invention has been described in only two embodiments. It should be apparent to those skilled in the art that the invention is not so limited, but is susceptible to various changes and modifications without departing from the spirit of the invention.

I claim:

1. A goal post pad for padding a goal post, comprising:

a foam pad wrapped around the goal post;

an outer layer of fabric, wrapped around the foam pad; and a slide fastener attached to the outer layer of fabric for securing the fabric and the foam pad to the goal post;

a lock for securing the slide fastener to prevent unauthorized removal of the fabric and foam pad from the post; and a cable having a ring on each end of the cable, wherein the outer layer of fabric has a lower edge, and the cable is attached to the lower edge, so the slide fastener can be locked to the rings with the lock.

2. A goal post pad for adding a goal post, comprising:

a foam pad wrapped around the goal post;

an outer layer of fabric, wrapped around the foam pad, wherein the fabric is a porous vinyl mesh; and a slide fastener attached to the outer layer of fabric for securing the fabric and the foam pad to the goal post.

3. A goal post pad for padding a goal post as recited in claim 2, further comprising a lock for securing the slide fastener to prevent unauthorized removal of the fabric and foam pad from the post.

4. A goal post pad for padding a goal post as recited in claim 3, further comprising a cable having a ring on each end of the cable, wherein the outer layer of fabric has a lower edge, and the cable is attached to the lower edge, so the slide fastener can be locked to the rings with the lock.

5. A goal post pad for padding a goal post, comprising:

a foam pad wrapped around the goal post;

an outer layer of fabric, bonded to the foam pad; and a slide fastener attached to the outer layer of fabric for securing the fabric and the foam pad to the goal post;

a lock for securing the slide fastener to prevent unauthorized removal of the fabric and foam pad from the post; and a cable having a ring on each end of the cable, wherein the outer layer of fabric has a lower edge, and the cable is attached to the lower edge, so the slide fastener can be locked to the rings with the lock.

6. A goal post pad for padding a goal post, comprising:

a foam pad wrapped around the goal post;

an outer layer of fabric, wrapped around the foam pad; and a slide fastener attached to the outer layer of fabric for securing the fabric and the foam pad to the goal post;

a lock for securing the slide fastener to prevent unauthorized removal of the fabric and foam pad from the post; and a cable having a ring on each end of the cable, wherein the outer layer of fabric has a lower edge, and the cable is located below the lower edge, so the slide fastener can be locked to the rings with the lock.

* * * * *